US006761441B2

(12) United States Patent
Lui

(10) Patent No.: US 6,761,441 B2
(45) Date of Patent: Jul. 13, 2004

(54) INK CARTRIDGE

(75) Inventor: Pui Kuong Lui, Mongkok Kowloon (HK)

(73) Assignee: Monitek Electronics Limited, Kowloon (HK)

( * ) Notice: Subject to any disclaimer, the term of this patent is extended or adjusted under 35 U.S.C. 154(b) by 0 days.

(21) Appl. No.: 10/272,950

(22) Filed: Oct. 18, 2002

(65) Prior Publication Data

US 2003/0112304 A1 Jun. 19, 2003

Related U.S. Application Data

(63) Continuation-in-part of application No. 10/014,525, filed on Dec. 14, 2001, now abandoned.

(51) Int. Cl.[7] ..... B41J 2/175
(52) U.S. Cl. ..... 347/86
(58) Field of Search ..... 347/84, 85, 86, 347/87

(56) References Cited

U.S. PATENT DOCUMENTS 5,886,721 A * 3/1999 Fujii et al. ..... 347/87
6,042,225 A * 3/2000 Altendorf et al. ..... 347/87
6,325,499 B1 * 12/2001 Betschon ..... 347/86

* cited by examiner

*Primary Examiner*—Anh T. N. Vo
(74) *Attorney, Agent, or Firm*—Rosenberg, Klein & Lee

(57) ABSTRACT

An ink cartridge includes an ink tank body for receiving an ink porous member which is a foam material for absorbing ink, a cover body for being covered with the ink tank body, an ink outlet port protruded outwardly from an outer surface of the ink tank body, and a stopping member arranged in the ink outlet port for receiving an ink delivery needle which the ink is flowed into; wherein the ink porous member has a substantially planar bottom surface relative to a substantially planar bottom surface of the tank body and is dimensioned to substantially fill the accommodating chamber in an uncompressed manner for efficiently supplying ink to the ink delivery needle.

2 Claims, 5 Drawing Sheets

INK CARTRIDGE

This is a continuation in part of application Ser. No. 10/014,525, filed Dec. 14, 2001, now abandoned.

BACKGROUND OF THE INVENTION

1. Field of the Invention

The present invention relates to an ink cartridge suitable for an ink jet printer, and more particularly to an ink cartridge having an ink porous member dimensioned to substantially fill the accommodating chamber in an uncompressed manner for efficiently supplying ink to an ink delivery needle of the ink jet printer.

2. The Prior Art

In the conventional ink jet printer, ink is loaded in an ink cartridge for supplying the ink to an ink delivery needle of the ink jet printer due to print paper. Referring to FIG. 1, the ink cartridge generally comprises an ink tank body 1*a* having an ink tank or a plurality of ink tanks for loading different color ink, wherein the ink tank body 1*a* is sealed with a cover body 2*a* thereon for forming a closure. The cover body 2*a* has an ink charging inlet 20*a* and an ambient air vent 21*a* and a sealing film 22*a* is attached on a top surface of the cover body 2*a* so as to seal the ambient air vent 21*a*. The tank body 1*a* has an ink outlet port 10*a* formed on a bottom plate 11*a* thereof and an accommodated chamber 12*a* defined therein for receiving an ink porous member 3*a*. Furthermore, in operation, first to remove the sealing film 22*a*, then to mount the ink cartridge into the ink jet printer, and the ink in fluid communication through the ink outlet port 10*a* of the ink tank body 1*a* to an ink delivery needle 5*a* of the ink jet printer.

However, in the conventional ink cartridge, the ink outlet port 10*a* is extended and projecting inwardly from an inner surface of the bottom plate 11*a* of the ink tank body 1*a*, and the ink porous member 3*a* originally has a substantially planar bottom surface 30*a* and its whole dimension is larger than that of the accommodated chamber 12*a* of the ink tank body 1*a*, so that the ink porous member 3*a* with the ink impregnated therein is positioned inside the ink tank body 1*a* and its substantially planar bottom surface 30*a* is abutting against the ink outlet port 10*a* thereby being compressed by the ink outlet port 10*a*. The pores of the ink porous member 3*a* are positioned adjacent to the ink outlet port 10*a* being smaller in size than the pores thereof positioned away from the ink outlet port 10*a*, which is known as the effect of compression.

Additionally, a stopping member 4*a* defines a passage 40*a* formed therein and is arranged in a vent end 13*a* of the ink outlet port 10*a*, and a laminated film 14*a* is sealed on an opening of the vent end 13*a* of the ink outlet port 10*a*, so that the laminated film 14*a* can be pierced by the ink delivery needle 5*a* that being fitted with the passage 40*a* of the stopping member 4*a*.

Please refer to FIG. 2, to provide an ink cartridge, which comprises a casing 2'*a* having a bottom wall 3'*a* which has an inside face 16'*a* upwardly protruded therefrom, rather than a substantially planar bottom surface, and the inside face 16'*a* defining an opening 8'*a* therethrough for being communicated with a print head, and an area of the inside face 16'*a* of the bottom wall 3'*a* around the opening 8'*a* having a plurality of radial grooves 17'*a* that open to the opening 8'*a* for the purpose increasing the flow area at the outlet port.

Further, a porous body 12'*a* is a cuboid body fill in an unfit space of the casing 2'*a* due to the inside face 16'*a* of the bottom wall 3'*a* so as to being slightly compressed by 2% to 6%.

SUMMARY OF THE INVENTION

The primary purpose of the present invention is to provide an ink cartridge, which includes an ink tank body with an accommodating chamber defining a dimension being completely same as that of the ink porous member positioned therein in an uncompressed manner, so that the ink porous member is impregnated with ink under low atmospheric pressure thereby to increase the amount of the impregnated ink.

Another purpose of the present invention is to provide an ink cartridge, which includes a stopping member having a sealing film integrally formed therein before the ink cartridge is used to the ink delivery needle without a laminated film sealed on an opening of the ink outlet port.

In accordance with one aspect of the present invention, an ink cartridge includes an ink tank body having a plurality of side walls and a bottom plate for defining an accommodating chamber therein, the bottom plate having an inner surface and an outer surface, a filter disposed on the inner surface thereof so as to form a substantially planar bottom surface of accommodating chamber, and a plurality of through holes formed in the bottom plate below the filter for restricting a flow rate of ink, an ink outlet port protruded outwardly from the outer surface of the bottom plate in aligned relationship with the through holes, a stopping member disposed in the ink outlet port for receiving an ink delivery needle, an ink porous member positioned in the accommodating chamber and having a substantially planar bottom surface relative to the substantially planar bottom surface of the tank body, and the ink porous member dimensioned to substantially fill the accommodating chamber in an uncompressed manner.

It is to be understood that both the foregoing general description and the following detailed description are exemplary, and are intended to provide further explanation of the invention as claimed. Other advantages and features of the invention will be apparent from the following description, drawings and claims.

DETAILED DESCRIPTION OF THE PREFERRED EMBODIMENT

Figure 1:
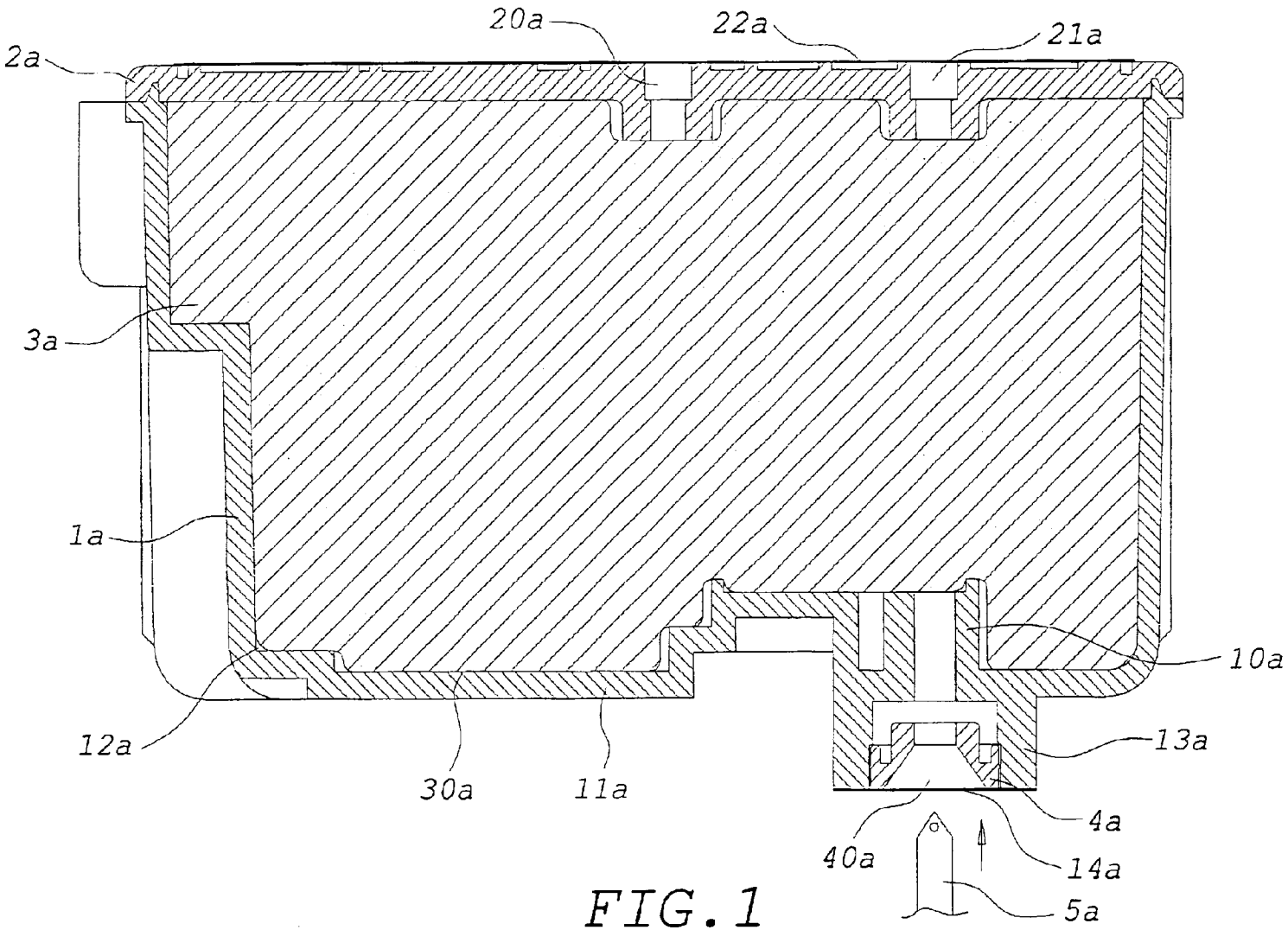
FIG. 1 PRIOR ART
FIG. 1 is a cross-sectional view of prior art.
Figure 2:
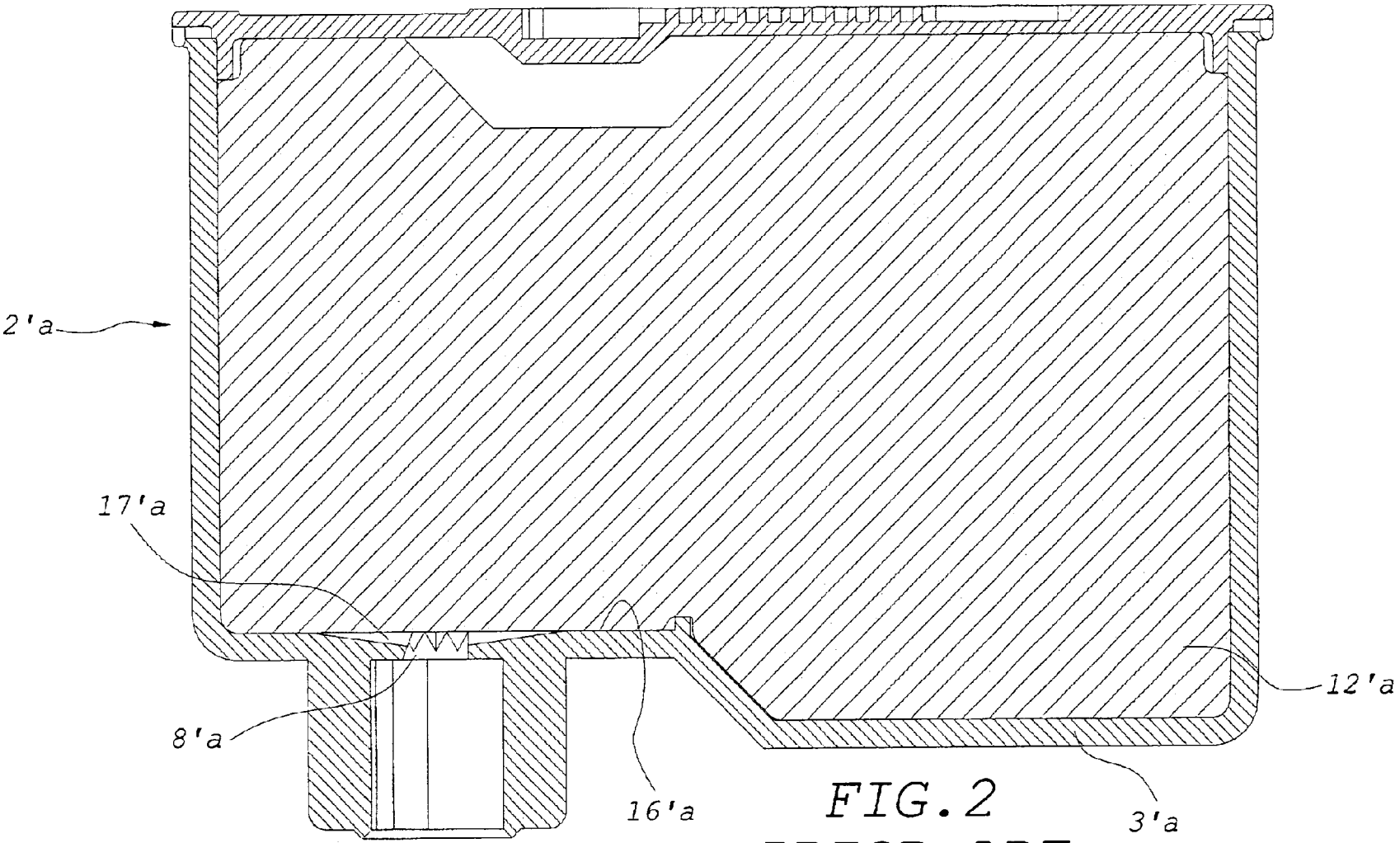
FIG. 2 PRIOR ART
FIG. 2 is a cross-sectional view of another prior art.
Figure 3:
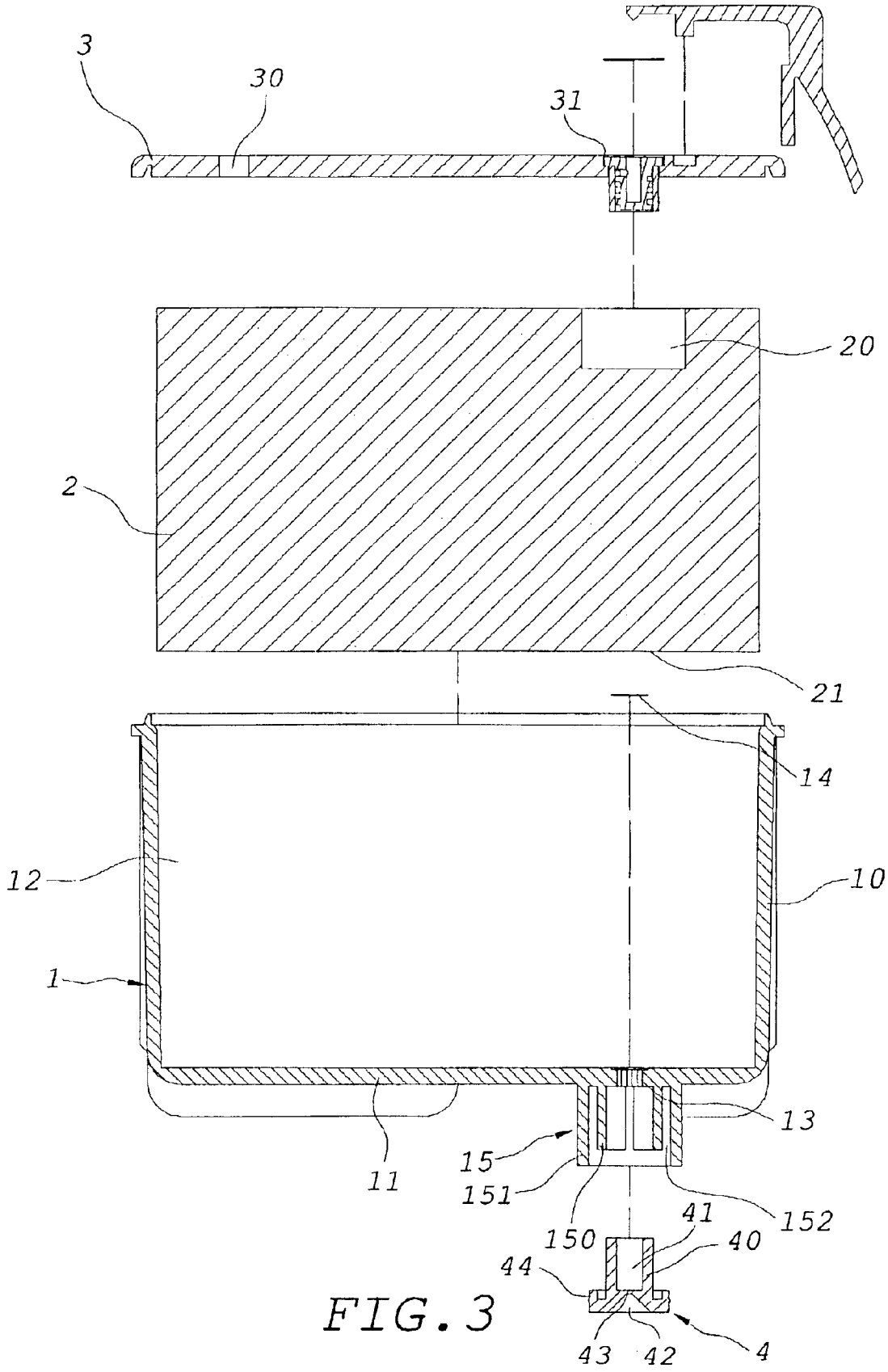
FIG. 3 is an exploded view of the ink cartridge of the present invention.
Figure 4:
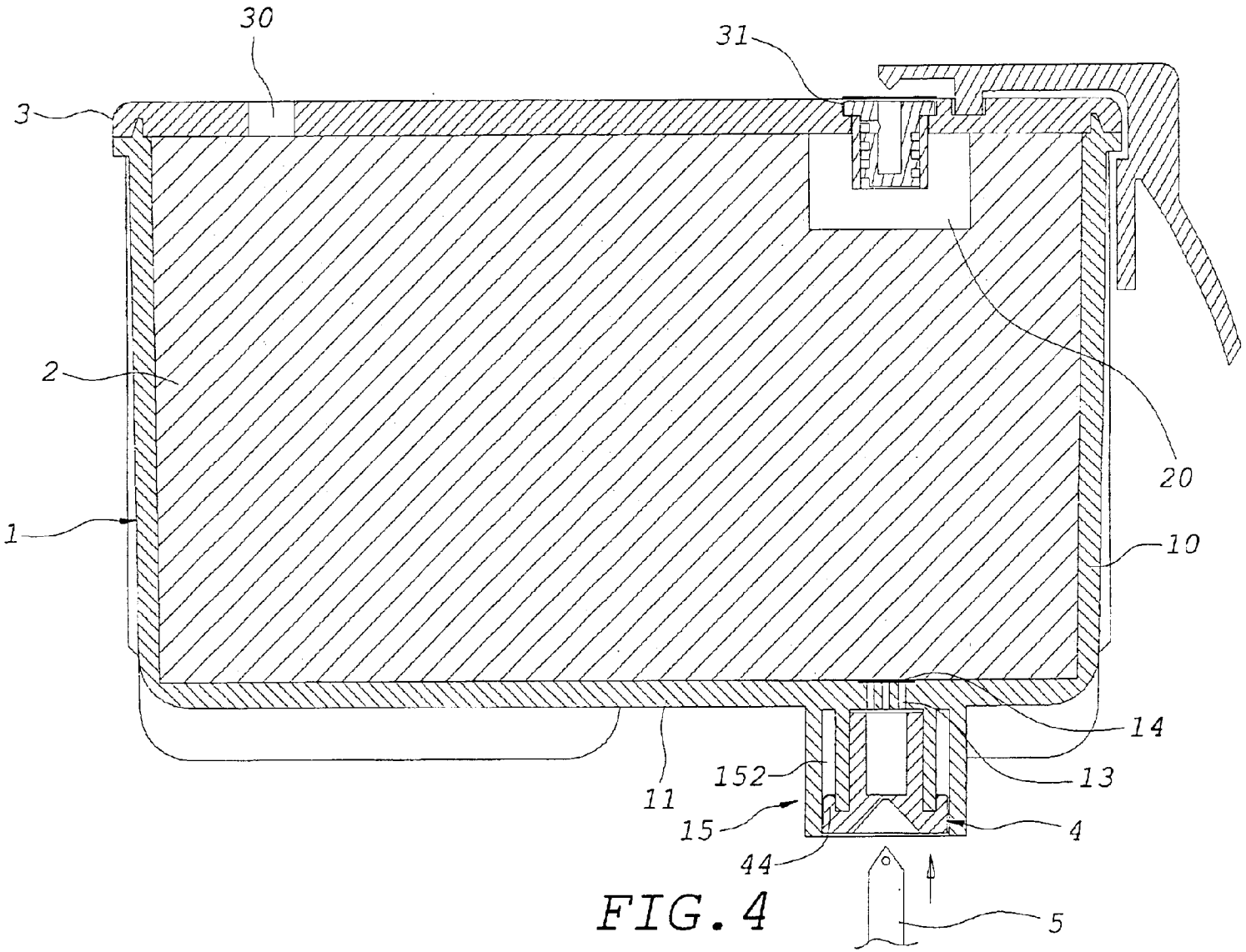
FIG. 4 is a cross-sectional view of the present invention before the ink cartridge is used to the ink delivery needle.
Figure 5:
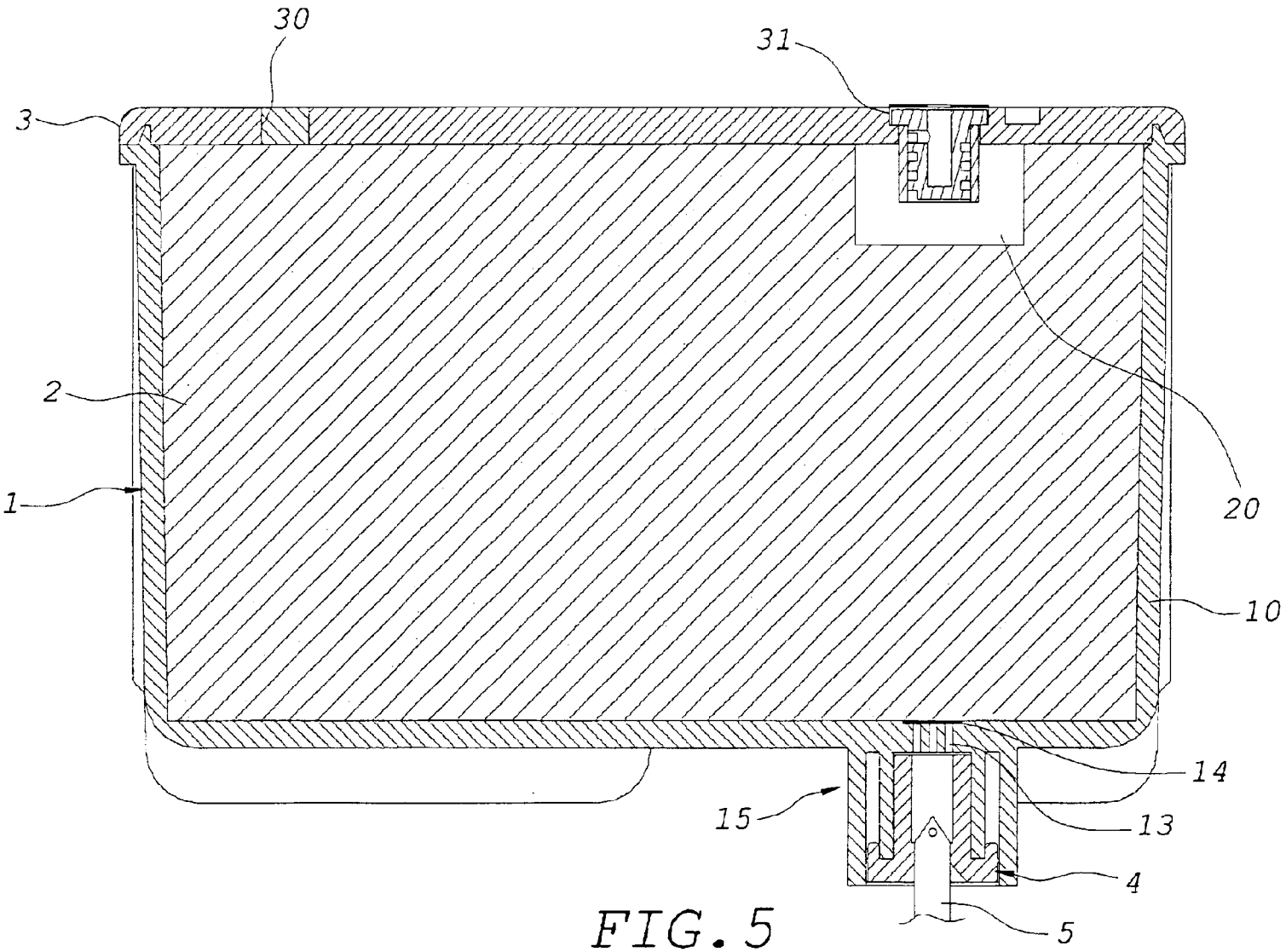
FIG. 5 is another cross-sectional view of the present invention after the ink cartridge is used to the ink delivery needle.

Referring to FIGS. 3 to 5, an ink cartridge in accordance with the present invention comprises an ink tank body 1 for receiving an ink porous member 2 which is a foam material for absorbing ink, a cover body 3 for being covered with the ink tank body 1, an ink outlet port 15 arranged on a bottom of the ink tank body 1, and a stopping member 4 arranged in the ink outlet port 15 for receiving an ink delivery needle 5 which the ink is flowed into, wherein:

The ink tank body 1 includes a plurality of side walls 10 having substantially planar inner surfaces and a bottom plate 11 being integrally formed with the side walls 10 thereby to define an accommodating chamber 12 therebetween due to single color ink or multi-color ink, the bottom plate 11 having an inner surface and an outer surface, a filter 14 disposed on the inner surface thereof so as to form a substantially planar bottom surface of accommodating chamber 12. The substantially planar bottom surface of the accommodating chamber 12 can be received with the ink porous member 2 having completely same shape and dimension as that of the accommodating chamber 12 of the tank body 1, so that the ink porous member 2 can have almost same pores in size from before and after it is positioned in the accommodating chamber 12, and the bottom plate 11 has a plurality of through holes 13 formed in the bottom plate 11 below the filter 14 for restricting a flow rate of ink between the accommodating chamber 12 and the ink outlet port 15, and the plurality of through holes 13 are distributed as a matrix-shape in a horizontal cross-section.

The ink outlet port 15 has a pipe-like shape and can be protruded outwardly from an outer surface of the bottom plate 11 of the ink tank body 1 in aligned relationship with the plurality of through holes 13 in the predetermined position, and the ink outlet port 15 is constructed to be communicated from an interior to an exterior of the ink cartridge to permit the flow of the ink. Another, the ink outlet port 15 has an inner cylindrical wall 150 and an outer cylindrical wall 151 concentrically surrounded with the inner cylindrical wall 150 to define a retaining gap 152.

The stopping member 4 has an inner ring 40 defining a cylindrical space 41, a frustro-conical space 42 separated from the cylindrical space 41 through a sealing film 43 integrally formed therein before the ink cartridge is used to the ink delivery needle 5, and an outer ring 44 formed thereon for fitting to the retaining gap 152 of the ink outlet port 15.

The ink porous member 2 has a plurality of fine holes being impregnated with ink under reduced pressure to substantially eliminate air bubbles therein, and the ink porous member 2 has an indentation 20 formed on a top surface thereof and a substantially planar bottom surface 21 relative to said substantially planar bottom surface of the tank body 1 and dimensioned to substantially fill the accommodating chamber 12 in an uncompressed manner, i.e. the ink porous member 2 has almost same fine pores in size from before and after it is positioned in the accommodating chamber 12 of the tank body 1, so that the ink porous member can be impregnated with ink under low atmospheric pressure thereby to increase the amount of the impregnated ink.

The cover body 3 forms a closure for the accommodating chamber 12 and has an ink charging inlet 30 and an air inlet port 31 formed therein.

To sum up, the ink cartridge can efficiently supply the ink to the ink delivery needle 5 of the ink jet printer without air or air bubbles supplying to the ink delivery needle 5. It is also desirable that such ink cartridge supplies an amount of the ink as required by the ink delivery needle 5.

Those skilled in the art will readily observe that numerous modification and alterations of the device may be made while retaining the teachings of the invention. Accordingly, the above disclosure should be construed as limited only by the metes and bounds of the appended claims.

What is claimed is:

1. An ink cartridge comprising:

an ink tank body having a plurality of side walls and a bottom plate for defining an accommodating chamber therein, the bottom plate having an inner surface and an outer surface, a filter disposed on the inner surface thereof so as to form a substantially planar bottom surface of the accommodating chamber, and a plurality of through holes formed in the bottom plate below the filter for restricting a flow rate of ink;

an ink outlet port protruded outwardly from the outer surface of the bottom plate of the ink tank body in aligned relationship with the plurality of through holes, the ink outlet port having an inner cylindrical wall and an outer cylindrical wall concentrically surrounded with the inner cylindrical wall to define a retaining gap;

a stopping member disposed in the ink outlet port for receiving an ink delivery needle;

an ink porous member positioned in the accommodating chamber of the tank body, the ink porous member having a substantially planar bottom surface relative to said substantially planar bottom surface of the tank body and dimensioned to substantially fill the accommodating chamber in an uncompressed manner; and a cover body forming a closure for the accommodating chamber and having an ink charging inlet and an air inlet port formed therein.

2. The ink cartridge as claimed in claim 1, wherein the stopping member has an inner ring defining a cylindrical space, a frustro-conical space separated from the cylindrical space through a sealing film integrally formed therein before the ink cartridge is used to the ink delivery needle, and an outer ring formed thereon for fitting to the retaining gap of the ink outlet port.

* * * * *